US012693039B2

(12) United States Patent
Mou et al.

(10) Patent No.: US 12,693,039 B2
(45) **Date of Patent: *Jul. 28, 2026**

(54) CONCEPTION OF LOCATING AND COMPLETELY CLEANING INDOOR AIR POLLUTION

(71) Applicant: Microjet Technology Co., Ltd., Hsinchu (TW)

(72) Inventors: Hao-Jan Mou, Hsinchu (TW); Yung-Lung Han, Hsinchu (TW); Chi-Feng Huang, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 876 days.

This patent is subject to a terminal disclaimer.

(21) Appl. No.: 17/866,802

(22) Filed: Jul. 18, 2022

(65) Prior Publication Data

US 2024/0003573 A1 Jan. 4, 2024

(30) Foreign Application Priority Data

Jun. 30, 2022 (TW) ..... 111124546

(51) Int. Cl.
*F24F 11/63* (2018.01)
*F24F 8/108* (2021.01)
(Continued)

(52) U.S. Cl.
CPC ..... *F24F 11/63* (2018.01); *F24F 8/108* (2021.01); *F24F 8/22* (2021.01); *F24F 8/24* (2021.01);
(Continued)

(58) Field of Classification Search
None
See application file for complete search history.

(56) References Cited

U.S. PATENT DOCUMENTS 7,302,313 B2 * 11/2007 Sharp ..... G01N 33/0075 700/282
10,001,288 B1 * 6/2018 Yang ..... F24F 11/79
(Continued)

FOREIGN PATENT DOCUMENTS

CN 111442432 A 7/2020
CN 113154661 A 7/2021
(Continued)

OTHER PUBLICATIONS

Extended European Search Report for corresponding European Application No. 22187823.4, dated Dec. 15, 2022.

*Primary Examiner* — Jason Lin
(74) *Attorney, Agent, or Firm* — Birch, Stewart, Kolasch & Birch, LLP

(57) ABSTRACT

A conception of locating and completely cleaning indoor air pollution is provided. A plurality of physical or chemical first devices are disposed to determine characteristics, concentrations and locations of air pollution. A fan, a physical second device or a chemical second device is selected and enabled in accordance with the position closest to the location of the air pollution to generate an airflow. Various mathematical operations and artificial intelligence operations are implemented to improve efficiency of locating the air pollution, draining the air pollution and completely cleaning the air pollution. A wired and wireless network is utilized to optimize efficacy of the physical second device or the chemical second device. The mathematical operations are utilized through the wired and wireless network to maximize effects of the physical second device and the chemical second device for completely cleaning the air pollution.

26 Claims, 21 Drawing Sheets

(51) Int. Cl.

| | |
|---|---|
| ***F24F 8/22*** | (2021.01) |
| ***F24F 8/24*** | (2021.01) |
| *F24F 110/64* | (2018.01) |
| *F24F 110/66* | (2018.01) |
| *F24F 110/70* | (2018.01) |

(52) U.S. Cl.
CPC ..... *F24F 2110/64* (2018.01); *F24F 2110/66* (2018.01); *F24F 2110/70* (2018.01)

(56) References Cited

U.S. PATENT DOCUMENTS

2003/0173579 A1* 9/2003 Ishii ..... H01L 25/072 257/178
2006/0064204 A1* 3/2006 Kim ..... G05D 1/0274 700/276
2008/0206092 A1* 8/2008 Crapser ..... A61L 9/127 422/123
2010/0036533 A1* 2/2010 Masuda ..... F24F 11/30 700/278
2011/0064605 A1* 3/2011 Hedman ..... A61L 9/015 422/1
2013/0170417 A1* 7/2013 Thomas ..... H04W 52/0216 370/311
2014/0260692 A1* 9/2014 Sharp ..... F24F 11/74 73/863.23
2015/0202565 A1* 7/2015 Qi ..... B01J 20/20 96/111
2017/0130978 A1* 5/2017 Edwards ..... F24F 11/79
2017/0130981 A1* 5/2017 Willette ..... F24F 11/30
2017/0246486 A1* 8/2017 Cazier ..... A61B 5/087
2017/0261979 A1* 9/2017 Km ..... B25J 9/1664
2018/0135879 A1* 5/2018 Ota ..... F24F 11/80
2018/0209681 A1* 7/2018 Song ..... F24F 11/77
2018/0328615 A1* 11/2018 Lo ..... F24F 11/745
2019/0108746 A1* 4/2019 Chang ..... B60H 1/008
2019/0381443 A1* 12/2019 Kim ..... G05B 19/042
2020/0224915 A1* 7/2020 Nourbakhsh ..... F24F 11/54
2021/0072713 A1* 3/2021 Matsumoto ..... G05B 19/042
2021/0095879 A1* 4/2021 Mou ..... F04B 41/06
2021/0151164 A1* 5/2021 Macary ..... A61M 21/02
2021/0245088 A1* 8/2021 Mou ..... B03C 3/47
2021/0364171 A1* 11/2021 Kleinberger ..... B01D 46/521
2022/0192454 A1* 6/2022 Viengkham ..... F24F 11/56
2022/0196269 A1* 6/2022 Mou ..... F24F 8/30
2022/0280897 A1* 9/2022 Mou ..... B01D 46/46
2023/0066057 A1* 3/2023 Fan ..... F24F 11/62

FOREIGN PATENT DOCUMENTS

| | | | |
|---|---|---|---|
| CN | 114646114 | A | 6/2022 |
| EP | 3 581 854 | A1 | 12/2019 |
| JP | 2010-227835 | A | 10/2010 |
| JP | 2011-2166 | A | 1/2011 |
| JP | 2016-75443 | A | 5/2016 |
| JP | 2018-191287 | A | 11/2018 |
| TW | I608203 | B | 12/2017 |
| TW | I723771 | B * | 4/2021 |
| WO | WO 2016/175473 | A1 | 11/2016 |
| WO | WO 2018/109522 | A1 | 6/2018 |
| WO | WO 2019/167585 | A1 | 9/2019 |

* cited by examiner

CONCEPTION OF LOCATING AND COMPLETELY CLEANING INDOOR AIR POLLUTION

FIELD OF THE INVENTION

The present disclosure relates to a conception of locating and completely cleaning indoor air pollution, and more particularly to a method of locating air pollution, draining air pollution and completely cleaning air pollution in an indoor space.

BACKGROUND OF THE INVENTION

In recent years, people pay more and more attention to the air quality around their living environment. Particulate matter (PM), such as $PM_1$, $PM_{2.5}$ and $PM_{10}$, carbon monoxide, carbon dioxide, total volatile organic compounds (TVOC), formaldehyde and even suspended particles, aerosols, bacteria and viruses contained in the air and exposed in the environment might affect human health, and even endanger people's life.

However, it is not easy to control the indoor air quality. In addition to the air quality of the outdoor space, the air environmental conditions and pollution sources, especially the dusts originated from poor air circulation in the indoor space, are the major factors that affect indoor air quality. In order to quickly improve the indoor air quality, several devices, such as air conditioners or air purifiers, are utilized to achieve the purpose of improving the indoor air quality.

Therefore, in order to intelligently and quickly detect the location of the indoor air pollution, effectively remove the indoor air pollution to form a clean and safe breathing air state, instantly monitor the indoor air quality, and quickly purify the indoor air when the indoor air quality is poor, it becomes important to find a solution to intelligently generate an airflow convection in the indoor space, quickly detect and locate the air pollution, and effectively control plural physical and/or chemical filtration devices to implement an intelligent airflow convection to accelerate airflow in the desired direction(s), and filter and remove air pollution sources in the indoor space by locating the air pollution, draining the air pollution and completely cleaning the air pollution in the indoor space so as to achieve a clean and safe breathing air state.

SUMMARY OF THE INVENTION

One object of the present disclosure is to provide a conception of locating and completely cleaning indoor air pollution. Since air pollution may occur at any time and may move around an indoor space, a plurality of physical and/or chemical gas detection devices are widely disposed to intelligently determine a characteristic, a concentration and a location of the air pollution. Moreover, while the wired and wireless network is used, and various mathematical operations and artificial intelligence operations are implemented through a cloud device to determine the location of the air pollution, a physical or chemical filtration device closest to the location of the air pollution is intelligently selected and enabled to generate an airflow, and the air pollution is quickly drained to at least one filtration device for filtering and completely cleaning the air pollution. As a result, air pollution-locating, air pollution-draining and air pollution-completely-cleaning are formed for handling the air pollution in the indoor space, and a clean and safe breathing air state is achieved.

In accordance with an aspect of the present disclosure, a conception of locating and completely cleaning indoor air pollution is provided. A plurality of physical first devices or a plurality of chemical first devices are widely disposed in an indoor space to determine a characteristic, a concentration and a location of air pollution. The air pollution may occur at any time and move around the indoor space at any time. A fan, a physical second device or a chemical second device is selected and enabled in accordance with the position closest to the location of the air pollution determined through the plurality physical first devices or the plurality of chemical first devices to generate an airflow. Particles of the air pollution and molecules of the air pollution are quickly drained to at least one of the physical second device or the chemical second device, so as to filter and completely clean the particles of the air pollution and the molecules of the air pollution completely. Various mathematical operations and artificial intelligence operations are implemented to improve efficiency of locating the air pollution, draining the air pollution and completely cleaning the air pollution. A wired and wireless network is utilized to optimize efficacy of the physical second device or the chemical second device for locating the air pollution, draining the air pollution and completely cleaning the air pollution. The mathematical operations are utilized through the wired and wireless network to maximize effects of the physical second device and the chemical second device for completely cleaning the air pollution.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present disclosure provides a conception of locating and completely cleaning indoor air pollution. Since air pollution may occur at any time and move around the indoor space at any time, a plurality of physical first devices or a plurality of chemical first devices are widely disposed in an indoor space to determine a characteristic, a concentration and a location of the air pollution. Then, a fan, a physical second device or a chemical second device that is closest to the location of the air pollution (determined through the plurality physical first devices or the plurality of chemical first devices) is selected and enabled to generate an airflow so that particles of the air pollution and molecules of the air pollution can be quickly drained to at least one of the physical second device or the chemical second device, so as to filter and completely clean the particles of the air pollution and the molecules of the air pollution completely. Various mathematical operations and artificial intelligence operations are implemented to improve the efficiency of locating the air pollution, draining the air pollution and completely cleaning the air pollution. A wired and wireless network is utilized to optimize efficacy of the physical second device or the chemical second device for locating the air pollution, draining the air pollution and completely cleaning the air pollution. The mathematical operations are utilized through the wired and wireless network to maximize effects of the physical second device and the chemical second device for completely cleaning the air pollution.

Figure 1:
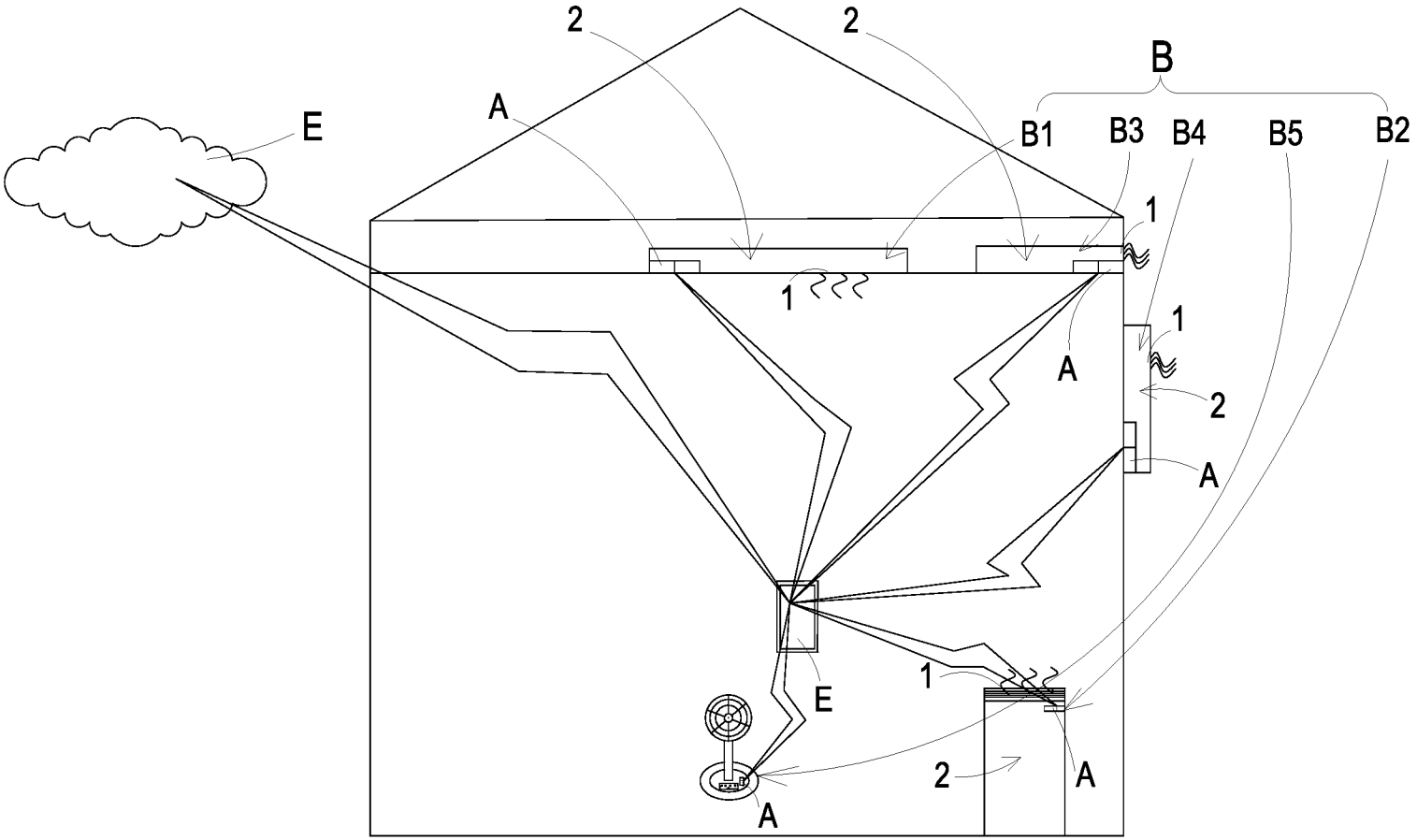
FIG. 1 is a schematic view illustrating a conception of locating and completely cleaning indoor air pollution in an indoor space according to an embodiment of the present disclosure.
Figure 2A:
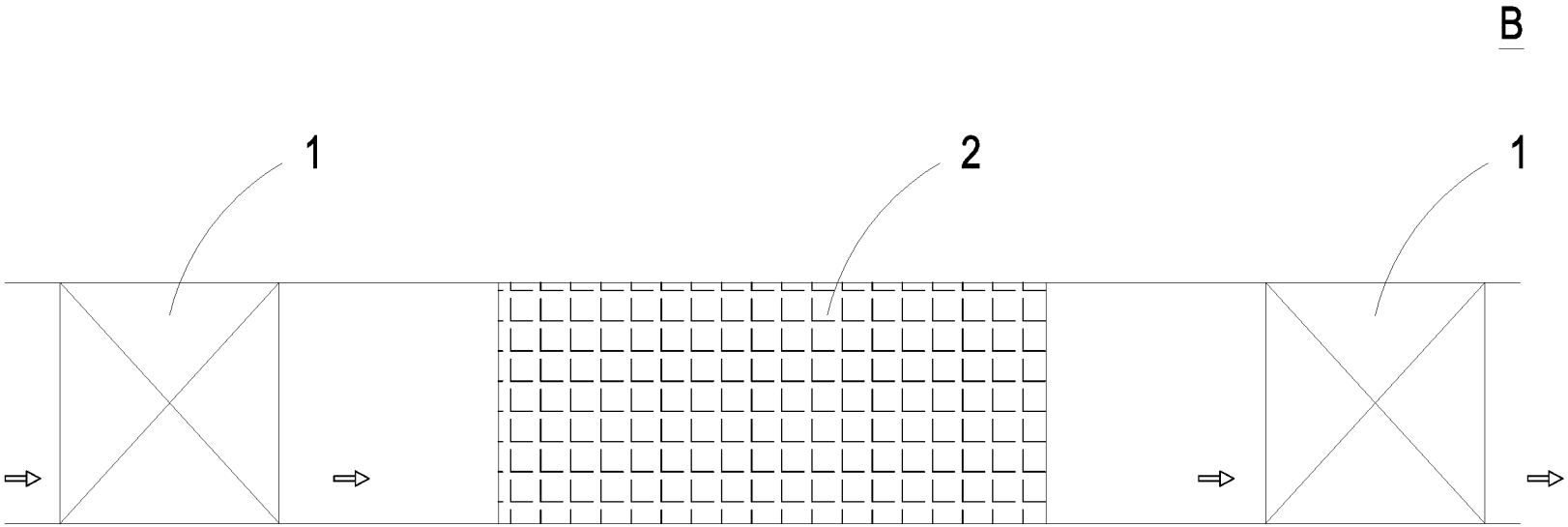
FIG. 2A is a schematic view illustrating a fan and a filter element of the physical second device or the chemical second device for the conception of locating and completely cleaning indoor air pollution according to the embodiment of the present disclosure.
Figure 2B:
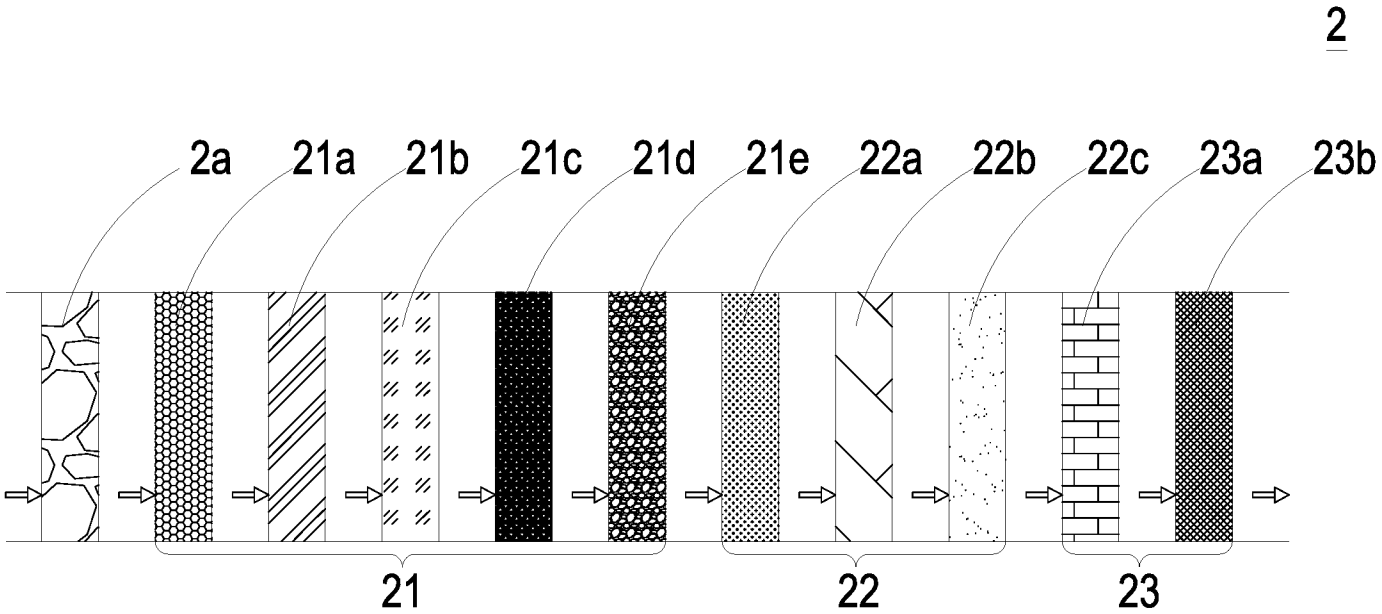
FIG. 2B is a schematic view illustrating the filter element according to the embodiment of the present disclosure.
Figure 3:
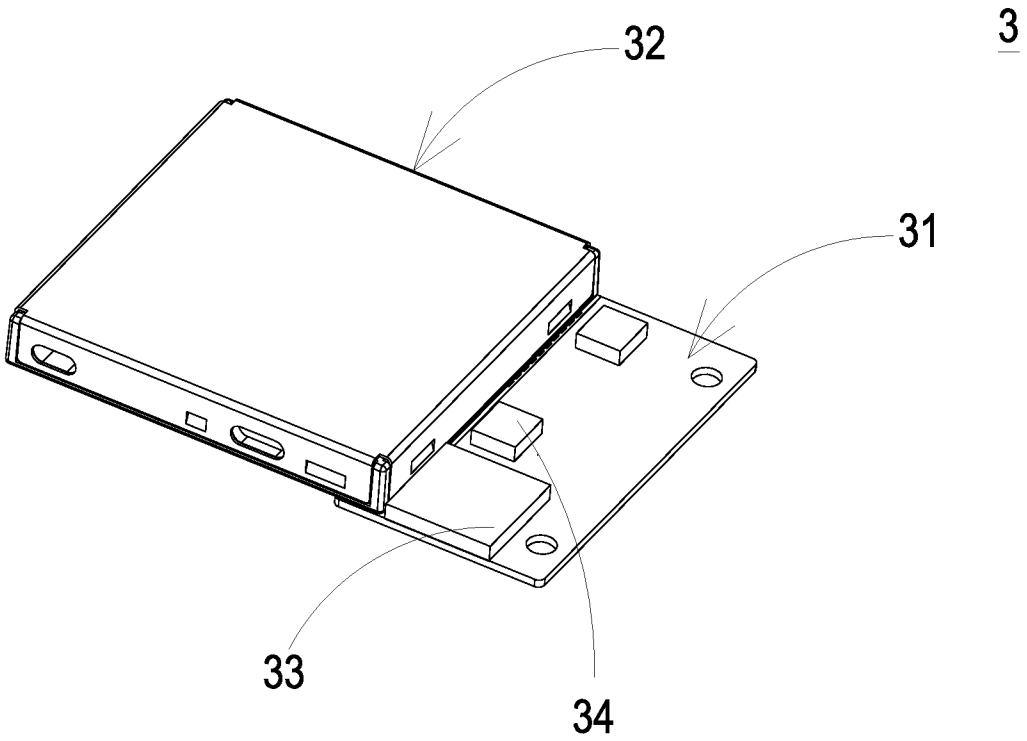
FIG. 3 is a schematic perspective view illustrating the gas detection device according to the embodiment of the present disclosure.
Figure 4A:
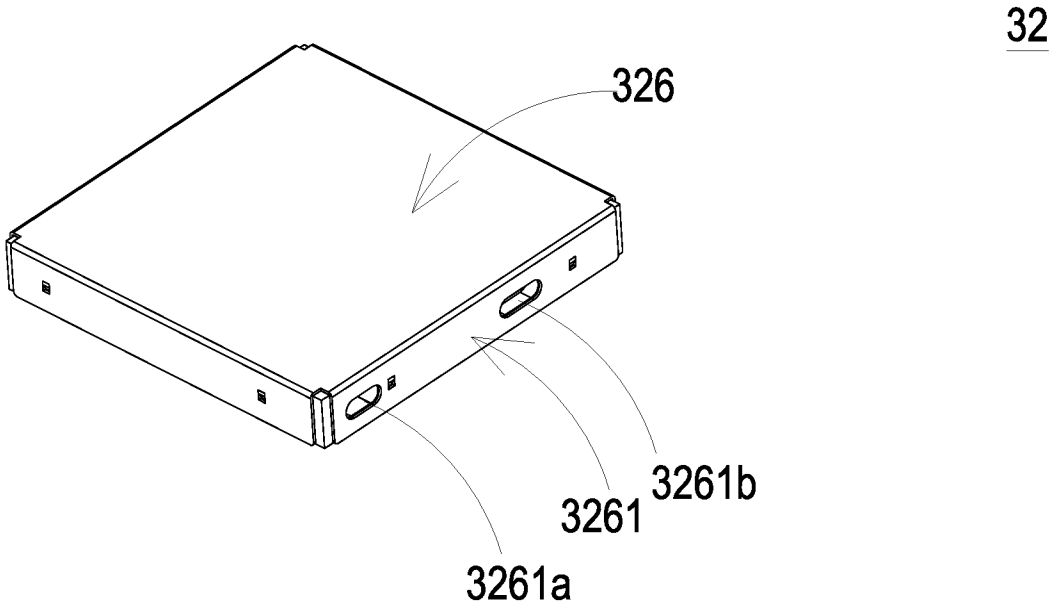
FIG. 4A is a schematic perspective view (1) illustrating the gas detection main part according to the embodiment of the present disclosure.
Figure 4B:
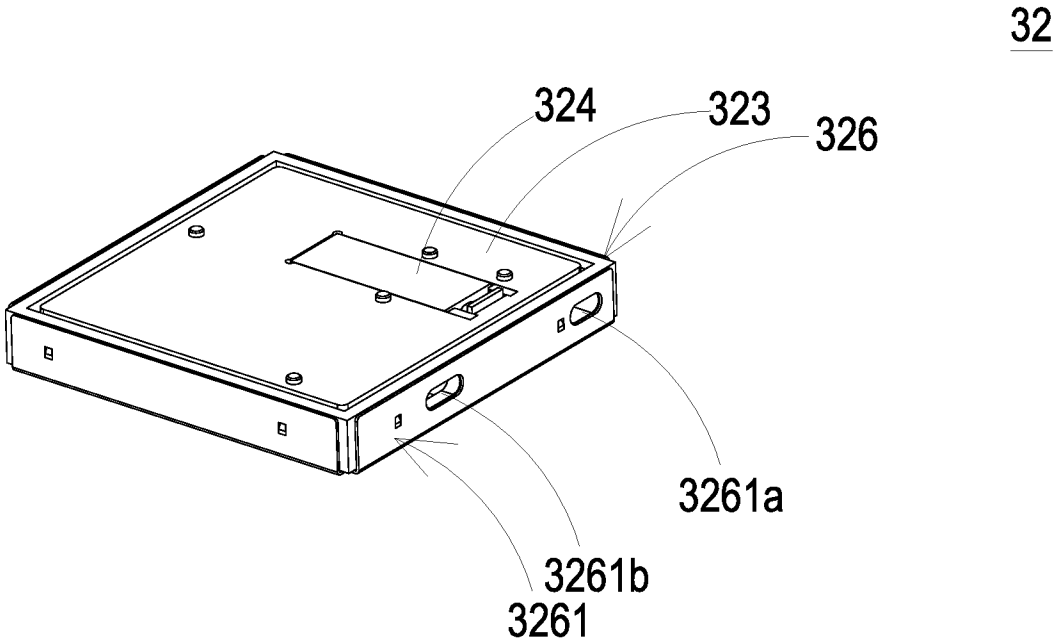
FIG. 4B is a schematic perspective view (2) illustrating the gas detection main part according to the embodiment of the present disclosure.
Figure 4C:
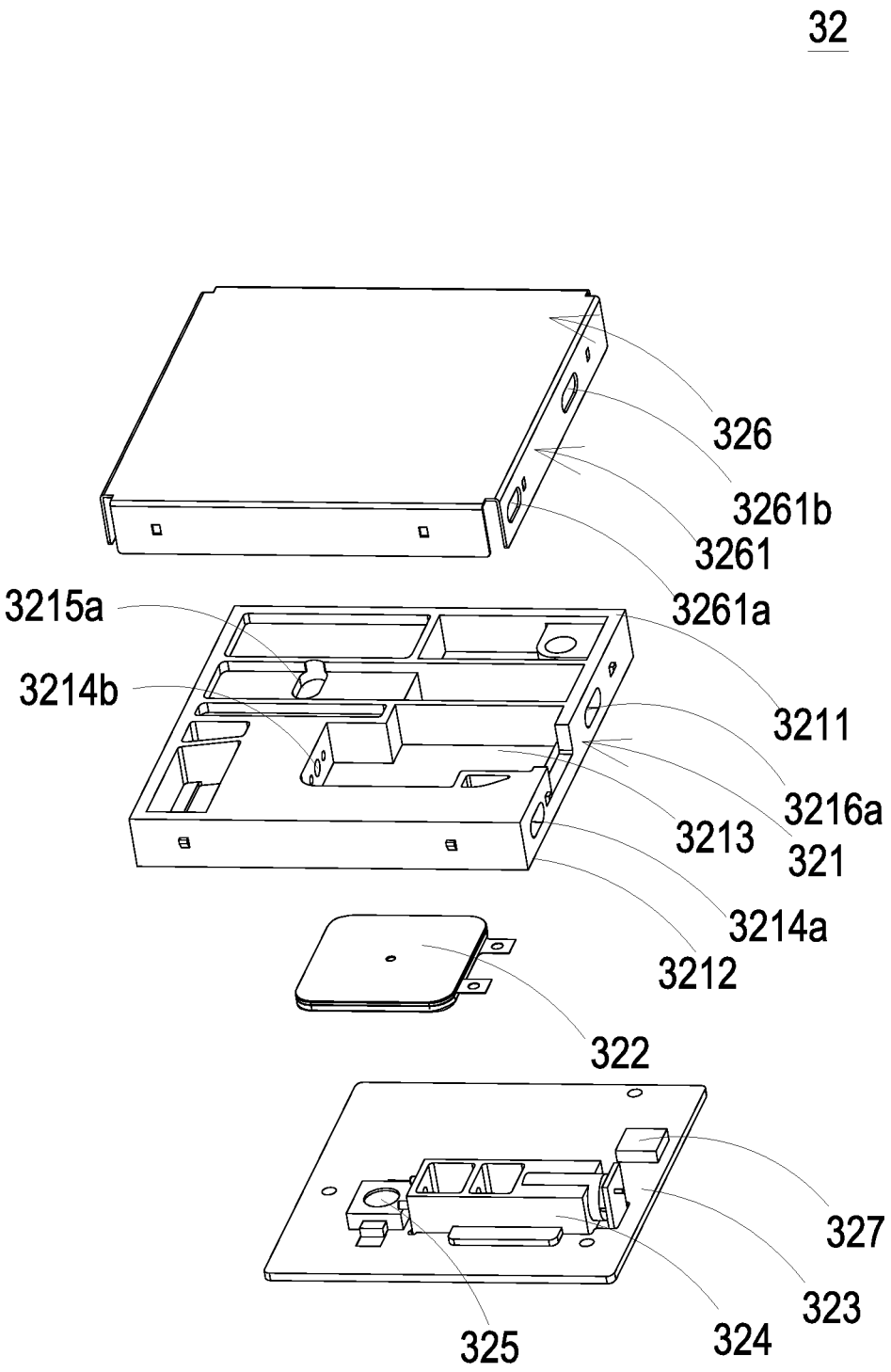
FIG. 4C is an exploded view illustrating the gas detection main part according to the embodiment of the present disclosure.
Figure 5A:
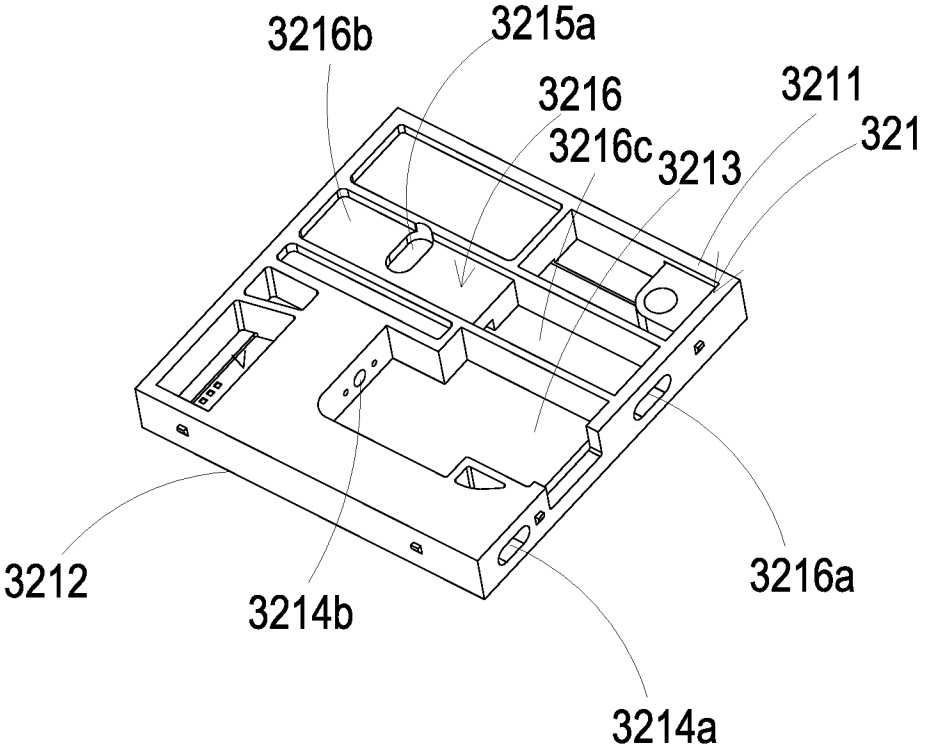
FIG. 5A is a schematic perspective view (1) illustrating the base according to the embodiment of the present disclosure.
Figure 5B:
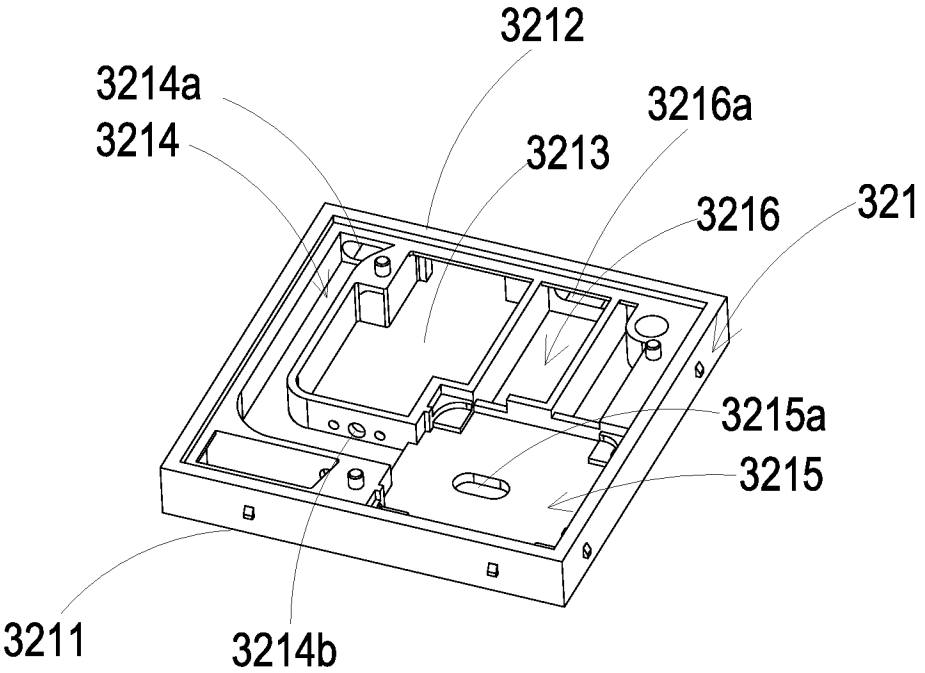
FIG. 5B is a schematic perspective view (2) illustrating the base according to the embodiment of the present disclosure.
Figure 6:
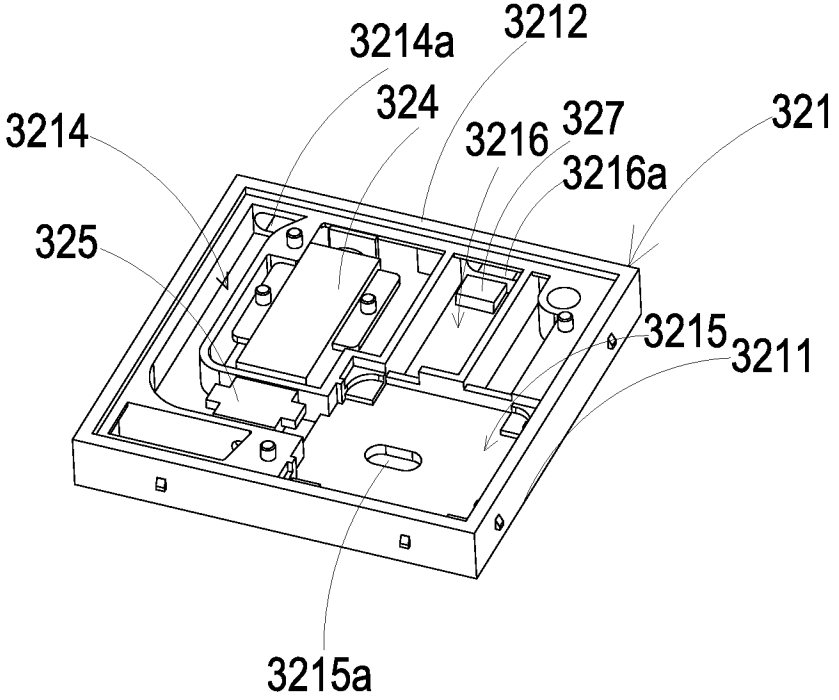
FIG. 6 is a schematic view (3) illustrating the base according to the embodiment of the present disclosure.
Figure 7A:
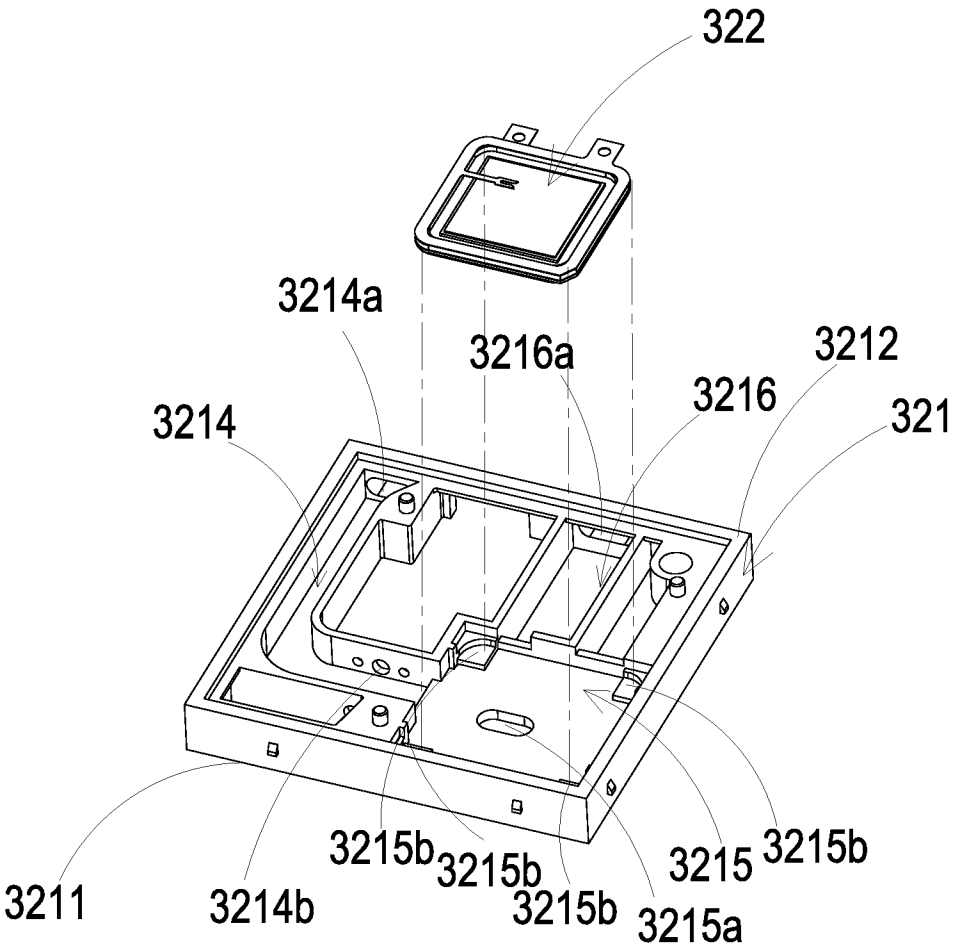
FIG. 7A is a schematic exploded view illustrating the combination of the piezoelectric actuator and the base according to the embodiment of the present disclosure.
Figure 7B:
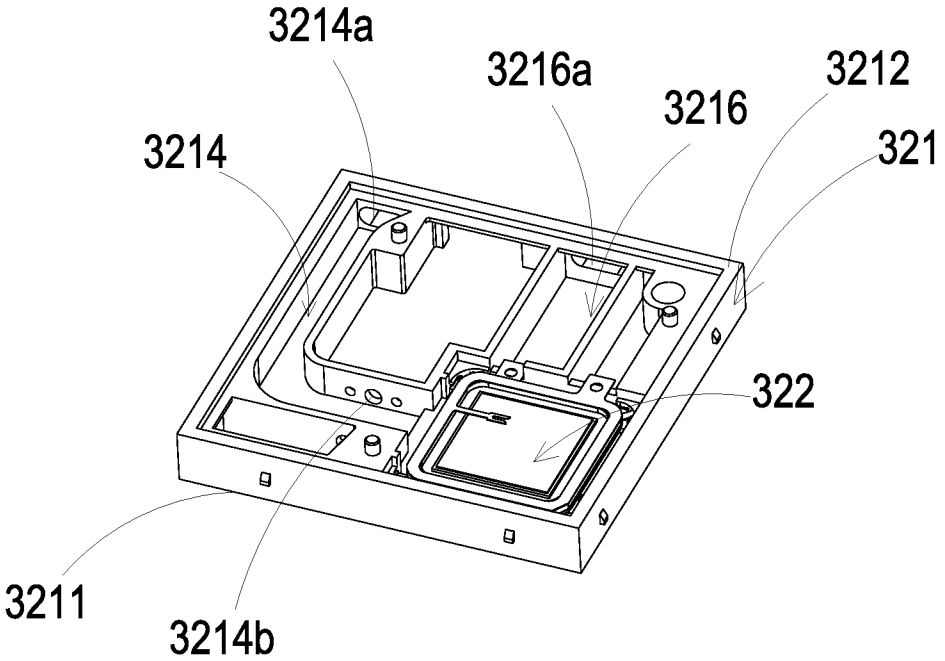
FIG. 7B is a schematic perspective view illustrating the combination of the piezoelectric actuator and the base according to the embodiment of the present disclosure.
Figure 8A:
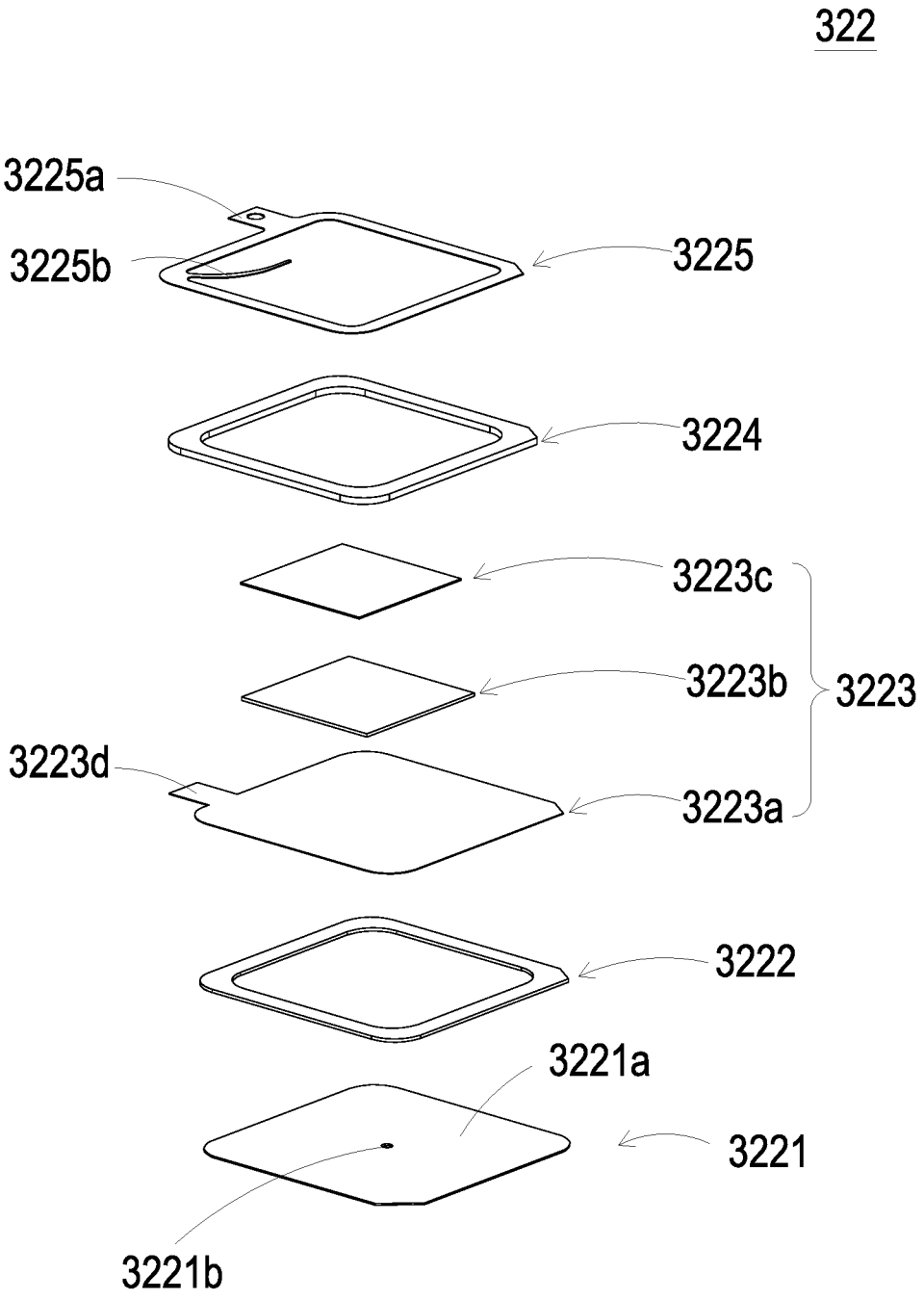
FIG. 8A is a schematic exploded view (1) illustrating the piezoelectric actuator according to the embodiment of the present disclosure.
Figure 8B:
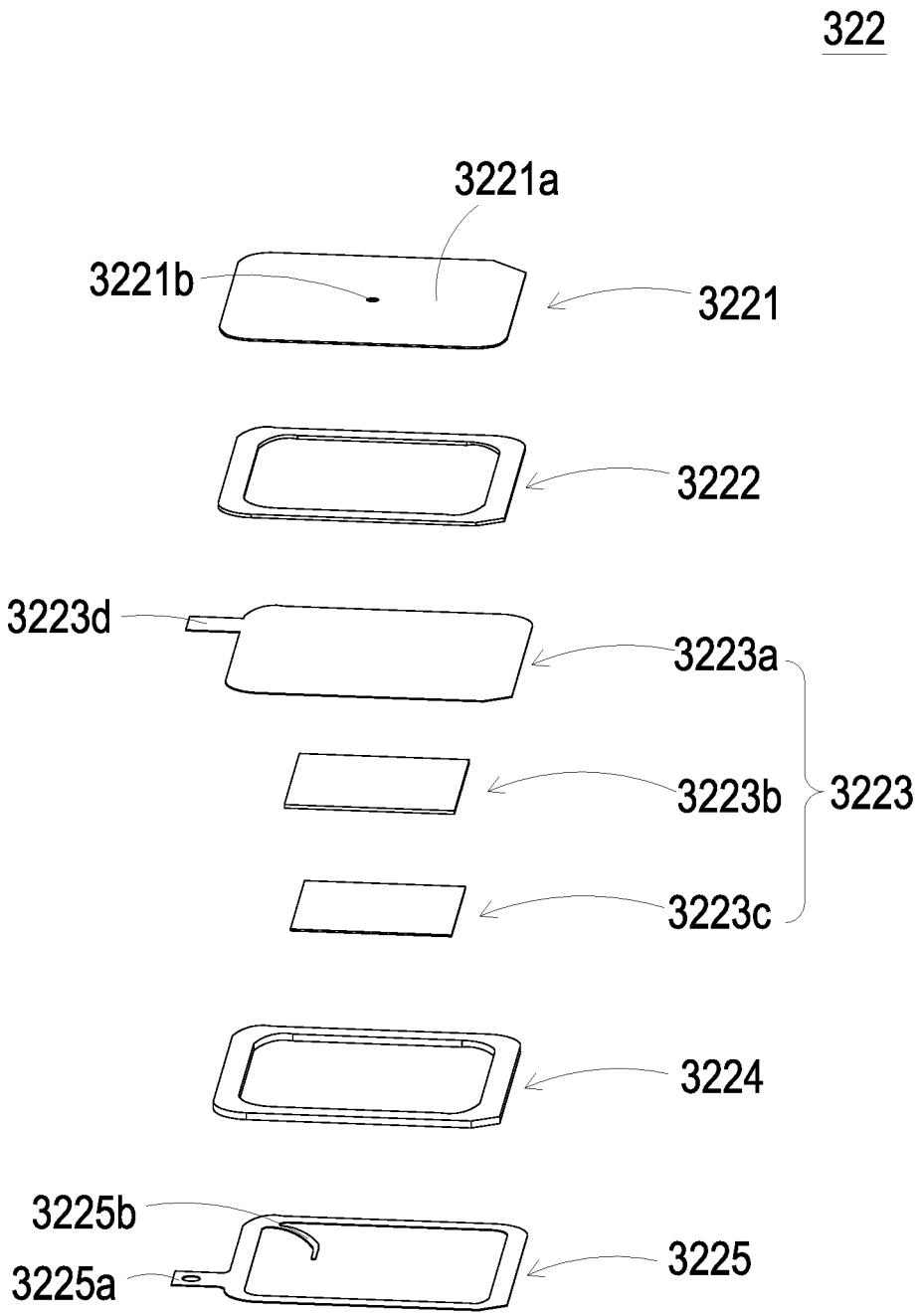
FIG. 8B is a schematic exploded view (2) illustrating the piezoelectric actuator according to the embodiment of the present disclosure.

Please refer to FIG. 1, FIG. 2A and FIG. 2B. According to the conception of the present disclosure, a plurality of physical first devices and a plurality of chemical first devices are widely disposed in the indoor space to determine a characteristic, a concentration and a location of the air pollution. Preferably but not exclusively, the physical first device or the chemical first device is a gas detection device A for detecting and outputting air pollution data, intelligently calculating the air pollution data to determine the location of the air pollution in the indoor space, and intelligently and selectively issuing a controlling instruction.

Secondly, a fan 1, a physical second device or a chemical second device that is closest to the location of the air pollution determined through the plurality physical first devices or the plurality of chemical first devices is selected and enabled. Preferably but not exclusively, the physical second device or the chemical second device is a filtration device B. Each of the physical filtration device B and the chemical filtration device B includes at least one filter element 2. When the fan 1 receives the controlling instruction, the fan 1 is driven to guide the airflow toward a direction, which quickly drain the particles of the air pollution and the molecules of the air pollution to at least one of the physical filtration device B or the chemical filtration device B, so as to filter and completely clean the particles of the air pollution and the molecules of the air pollution completely.

Then, various mathematical operations and artificial intelligence operations are implemented to improve efficiency of locating the air pollution, draining the air pollution and completely cleaning the air pollution. Preferably but not exclusively, the various mathematical operations and artificial intelligence operations are artificial intelligence operations and big data comparison. Certainly, a wired and wireless network is utilized to optimize efficacy of the physical second device or the chemical second device for locating the air pollution, draining the air pollution and completely cleaning the air pollution. The mathematical operations are utilized through the wired and wireless network to maximize effects of the physical second device and the chemical second device for completely cleaning the air pollution. That is, the wired and wireless network is utilized, and the various mathematical operations and artificial intelligence operations are implemented through a cloud device E to determine the location of the air pollution. Thereafter, the fan 1, the physical filtration device B or the chemical filtration device B that is closest to the location of the air pollution is selected and enabled to generate an airflow, and the air pollution are quickly drained to at least one of the physical filtration device B or chemical filtration device B for filtering and completely cleaning the air pollution to form a clean and safe breathing air state, so as to achieve the effects of locating the air pollution, draining the air pollution and completely cleaning the air pollution Notably, in the embodiment, the air pollution is at least one selected from the group consisting of particulate matter, carbon monoxide, carbon dioxide, ozone, sulfur dioxide, nitrogen dioxide, lead, total volatile organic compounds (TVOC), formaldehyde, bacteria, fungi, virus and a combination thereof.

Please refer to FIG. 2A and FIG. 2B. The plurality of physical first devices or the plurality of chemical first devices are the gas detection devices A. The physical second device or the chemical second device is a filtration device B. The description of the first physical device or the first chemical device is omitted, because the description of the gas detection device A is provided hereinafter. Moreover, the description of the second physical device or the second chemical device is omitted, because the description of the filtration device B is provided hereinafter. In an embodiment, the plurality of gas detection devices A are widely disposed in the indoor space for detecting the characteristic and the concentration of the air pollution. In addition, each of the gas detection A is used for detecting and outputting the air pollution data, and implementing the various mathematical operations and artificial intelligence operations to determine the location of the air pollution. Moreover, the various mathematical operations and artificial intelligence operations are implemented through the cloud device E for connecting the air pollution data outputted from the plurality of gas detection devices A. The artificial intelligence operations and big data comparison are implemented through the cloud device E to find out the location of the air pollution in the indoor space. As a result, a controlling instruction is intelligently and selectively issued through the wired and wireless network and transmitted to drive the fan 1, the physical filtration device B or the chemical filtration device B. That is, the air pollution data detected and provided by the plurality of gas detection devices A are compared to determine the value of the air pollution data through the intelligence operations, so that the location of the air pollution is determined, and the controlling instruction is transmitted through the communication transmission to drive the fan 1, the physical filtration device B or the chemical filtration device B. Preferably but not exclusively, each of the physical filtration device B or the chemical filtration device B includes at least one filter element 2, and the fan 1 can intake or exhaust gas in both directions. In an airflow path (the direction shown by the arrow), the fan 1 is disposed at the front side of the filter element 2, or the fan 1 is disposed at the rear side of the filter element 2. As shown in FIG. 2A, the fans 1 are arranged at the front and rear sides of the filter element 2. Certainly, in other embodiments, the arrangement of the fans 1 is designed and adjustable according to the practical requirements.

Notably, in the embodiment, the physical filtration device B or the chemical filtration device B is, for example but not limited to, a fresh air fan B1, a purifier B2, an exhaust fan B3, a range hood B4 or an electric fan B5. Certainly, the type and/or the number of the fan 1, the physical filtration device B and the chemical filtration device B is not limited to one. For example, the number of the fan 1 or the filtration device B is more than one.

In addition, notably, the various mathematical operations and artificial intelligence operations are implemented by using the plurality of gas detection devices A to receive and compare the air pollution data detected in the indoor space through the connection of the cloud device E. Then, the air pollution data that is intelligently calculated to be the highest one is used to determine the location of the air pollution in the indoor space. Thereafter, a controlling instruction is intelligently and selectively issued to enable the fan 1, the physical filtration device B or the chemical filtration device B that is closest to the location of the air pollution first, and then the controlling instruction is intelligently and selectively issued to enable the rest of the fans 1, the rest of the physical filtration devices B or the rest of the chemical filtration devices B, so as to form the airflow (convection) toward a direction. Whereby, the flow of the air pollution is accelerated to drain by the airflow toward the filter element 2 of the physical filtration device B or the chemical filtration device B closest to the location of the air pollution for filtering and completely cleaning, and the effects of filtering and completely cleaning are achieved on the air pollution in the indoor space to form a clean and safe breathing air state. In other words, while the plurality of gas detection devices A are connected through the cloud device E for outputting the detected air pollution data and implementing the artificial intelligence operations and big data comparison, the fan 1, the physical filtration device B or the chemical filtration device B closest to the location of the air pollution is allowed to receive the controlling instruction, so as to be enabled for operation, and an airflow is generated first. Then, the controlling instruction is intelligently and selectively issued to enable the rest of the fans 1, the physical filtration devices B or the chemical filtration devices B in accordance with the position farther from the location of the air pollution for operation, so that the airflow (convection) is guided toward a direction. Whereby the flow of the air pollution is accelerated to drain by the airflow toward the filter element 2 of the physical filtration device B or the chemical filtration device B closest to the location of the air pollution for filtering and completely cleaning, and the effects of filtering and completely cleaning are achieved on the air pollution in the indoor space to form a clean and safe breathing air state.

Notably, what the air pollution is "completely cleaned" or "completely clean" means that the air pollution is filtered and cleaned to reach a safety detection value. Preferably but not exclusively, in some embodiments, the air pollution is completely cleaned means the safety detection value is zero to form a clean and safe breathing air state. Preferably but not exclusively, the safety detection value may also include at least one selected from the group consisting of a concentration of PM2.5 which is less than 35 $\mu g/m^3$, a concentration of carbon dioxide which is less than 1000 ppm, a concentration of total volatile organic compounds which is less than 0.56 ppm, a concentration of formaldehyde which is less than 0.08 ppm, a colony-forming unit of bacteria which is less than 1500 $CFU/m^3$, a colony-forming unit of fungi which is less than 1000 $CFU/m^3$, a concentration of sulfur dioxide which is less than 0.075 ppm, a concentration of nitrogen dioxide which is less than 0.1 ppm, a concentration of carbon monoxide which is less than 9 ppm, a concentration of ozone which is less than 0.06 ppm, and a concentration of lead which is less than 0.15 $jug/m^3$.

Please refer to FIG. 2B. In the embodiment, the filter element 2 of the physical filtration device B is a blocking and absorbing filter screen to form a physical removal device. Preferably but not exclusively, the filter screen is a high efficiency particulate air (HEPA) filter screen 2*a*, which is configured to absorb the chemical smoke, the bacteria, the dust particles and the pollen contained in the air pollution, so that the air pollution introduced into the filter element 2 is filtered and purified to achieve the effect of filtering and purification. In the embodiment, the filter element 2 of the chemical filtration device B is coated with a decomposition layer 21 to form a chemical removal device. Preferably but not exclusively, the decomposition layer 21 is an activated carbon 21*a*, which is configured to remove the organic and inorganic substances in the air pollution and remove the colored and odorous substances. Preferably but not exclusively, the decomposition layer 21 is a cleansing factor containing chlorine dioxide layer 21*b*, which is configured to inhibit viruses, bacteria, fungi, influenza A, influenza B, enterovirus and norovirus in the air pollution introduced into the filter element 2, and the inhibition ratio can reach 99%, thereby reducing the cross-infection of viruses. Preferably but not exclusively, the decomposition layer 21 is an herbal protective layer 21*c*, which is configured to resist allergy effectively and destroy a surface protein of influenza virus (H1N1) passing therethrough. Preferably but not exclusively, the decomposition layer 21 is a silver ion 21*d*, which is configured to inhibit viruses, bacteria and fungi contained in the air pollution. Preferably but not exclusively, the decomposition layer 21 is a zeolite 21*e*, which is configured to remove ammonia nitrogen, heavy metals, organic pollutants, *Escherichia coli*, phenol, chloroform and anionic surfactants. In an embodiment, the filter element 2 of the chemical filtration device B is combined with a light irradiation element 22 to form a chemical removal device. Preferably but not exclusively, the light irradiation element 22 is a photo-catalyst unit including a photo catalyst 22*a* and an ultraviolet lamp 22*b*. When the photo catalyst 22*a* is irradiated by the ultraviolet lamp 22*b*, the light energy is converted into the chemical energy to decompose harmful substances contained in the air pollution and disinfect bacteria contained in the air pollution, so as to achieve the effects of filtering and purifying. Preferably but not exclusively, the light irradiation element 22 is a photo-plasma unit including a nanometer irradiation tube 22*c*. When the air pollution is irradiated by the nanometer irradiation tube 22*c*, oxygen molecules and water molecules contained in the air pollution are decomposed into high oxidizing photo-plasma, and generates an ion flow capable of destroying organic molecules. In that, volatile formaldehyde, volatile toluene and volatile organic compounds (VOC) contained in the air pollution are decomposed into water and carbon dioxide, so as to achieve the effects of filtering and purifying. In an embodiment, the filter element 2 of the chemical filtration device B is combined with a decomposition unit 23 to form a chemical removal device. Preferably but not exclusively, the decomposition unit 23 is a negative ion unit 23*a*. It makes the suspended particles contained in the air pollution to carry with positive charge and adhered to a dust collecting plate carry with negative charges, so as to achieve the effects of filtering and purifying the air pollution introduced. Preferably but not exclusively, the decomposition unit 23 is a plasma ion unit 23*b*. Through the plasma ions, the oxygen molecules and the water molecules contained in the air pollution are decomposed into positive hydrogen ions ($H^+$) and negative oxygen ions ($O_2^-$), and the substances attached with water around the ions are adhered on the surface of viruses and bacteria and converted into OH radicals with extremely strong oxidizing power, thereby removing hydrogen (H) from the protein on the surface of viruses and bacteria, and thus decomposing (oxidizing) the protein, so as to filter the introduced air pollution and achieve the effects of filtering and purifying.

In order to understand the implementation of the method of the present disclosure, the structure of the gas detection device A of the present disclosure is described in detail as follows.

Please refer to FIG. 3 to FIG. 11. In the embodiment, the gas detection device 3 includes a controlling circuit board 31, a gas detection main part 32, a microprocessor 33 and a communicator 34. The gas detection main part 32, the microprocessor 33 and the communicator 34 are integrally packaged on the controlling circuit board 31 and electrically connected to each other. Preferably but not exclusively, the microprocessor 33 and the communicator 34 are disposed on the controlling circuit board 31, and the microprocessor 33 controls the driving signal of the gas detection main part 32 to enable the detection. The gas detection main part 32 detects the air pollution and outputs a detection signal. The microprocessor 33 receives the detection signal for calculating, processing and outputting, so that the microprocessor 33 of the gas detection device 3 generates the air pollution data, which are provided to the communicator 34, and externally transmitted to a connection device through a wireless communication transmission. Preferably but not exclusively, the wireless communication transmission is one selected from the group consisting of a Wi-Fi communication transmission, a Bluetooth communication transmission, a radio frequency identification communication transmission and a near field communication (NFC) transmission.

Please refer to FIG. 4A to FIG. 9A. In the embodiment, the gas detection main part 32 includes a base 321, a piezoelectric actuator 322, a driving circuit board 323, a laser component 324, a particulate sensor 325 and an outer cover 326. In the embodiment, the base 321 includes a first surface 3211, a second surface 3212, a laser loading region 3213, a gas-inlet groove 3214, a gas-guiding-component loading region 3215 and a gas-outlet groove 3216. The first surface 3211 and the second surface 3212 are two surfaces opposite to each other. In the embodiment, the laser loading region 3213 for the laser component 324 is hollowed out from the first surface 3211 toward the second surface 3212. The outer cover 326 covers the base 321 and includes a side plate 3261. The side plate 3261 has an inlet opening 3261*a* and an outlet opening 3261*b*. The gas-inlet groove 3214 is concavely formed from the second surface 3212 and disposed adjacent to the laser loading region 3213. The gas-inlet groove 3214 includes a gas-inlet 3214*a* and two lateral walls. The gas-inlet 3214*a* is in communication with an environment outside the base 321, and is spatially corresponding in position to an inlet opening 3261*a* of the outer cover 326. Two transparent windows 3214*b* are opened on the two lateral walls of the gas-inlet groove 3214 and are in communication with the laser loading region 3213. Therefore, the first surface 3211 of the base 321 is covered and attached by the outer cover 326, and the second surface 3212 is covered and attached by the driving circuit board 323, so that an inlet path is defined by the gas-inlet groove 3214.

In the embodiment, the gas-guiding-component loading region 3215 mentioned above is concavely formed from the second surface 3212 and in communication with the gas-inlet groove 3214. A ventilation hole 3215*a* penetrates a bottom surface of the gas-guiding-component loading region 3215. The gas-guiding-component loading region 3215 includes four positioning protrusions 3215*b* disposed at four corners of the gas-guiding-component loading region 3215, respectively. In the embodiment, the gas-outlet groove 3216 includes a gas-outlet 3216*a*, and the gas-outlet 3216*a* is spatially corresponding to the outlet opening 3261*b* of the outer cover 326. The gas-outlet groove 3216 includes a first section 3216*b* and a second section 3216*c*. The first section 3216*b* is concavely formed out from the first surface 3211 in a region spatially corresponding to a vertical projection area of the gas-guiding-component loading region 3215. The second section 3216*c* is hollowed out from the first surface 3211 to the second surface 3212 in a region where the first surface 3211 is extended from the vertical projection area of the gas-guiding-component loading region 3215. The first section 3216*b* and the second section 3216*c* are connected to form a stepped structure. Moreover, the first section 3216*b* of the gas-outlet groove 3216 is in communication with the ventilation hole 3215*a* of the gas-guiding-component loading region 3215, and the second section 3216*c* of the gas-outlet groove 3216 is in communication with the gas-outlet 3216*a*. In that, when first surface 3211 of the base 321 is attached and covered by the outer cover 326 and the second surface 3212 of the base 321 is attached and covered by the driving circuit board 323, the gas-outlet groove 3216 and the driving circuit board 323 collaboratively define an outlet path.

In the embodiment, the laser component 324 and the particulate sensor 325 are disposed on and electrically connected to the driving circuit board 323 and located within the base 321. In order to clearly describe and illustrate the positions of the laser component 324 and the particulate sensor 325 in the base 321, the driving circuit board 323 is intentionally omitted. The laser component 324 is accommodated in the laser loading region 3213 of the base 321, and the particulate sensor 325 is accommodated in the gas-inlet groove 3214 of the base 321 and is aligned to the laser component 324. In addition, the laser component 324 is spatially corresponding to the transparent window 3214*b*. Therefore, a light beam emitted by the laser component 324 passes through the transparent window 3214*b* and is irradiated into the gas-inlet groove 3214. A light beam path from the laser component 324 passes through the transparent window 3214*b* and extends in an orthogonal direction perpendicular to the gas-inlet groove 3214. Preferably but not exclusively, the particulate sensor 325 is used for detecting the suspended particulate information. In the embodiment, a projecting light beam emitted from the laser component 324 passes through the transparent window 3214*b* and enters the gas-inlet groove 3214 to irradiate the suspended particles contained in the gas passing through the gas-inlet groove 3214. When the suspended particles contained in the gas are irradiated and generate scattered light spots, the scattered light spots are received and calculated by the particulate sensor 325 to obtain the gas detection information. In the embodiment, a gas sensor 327 is positioned and disposed on the driving circuit board 323, electrically connected to the driving circuit board 323, and accommodated in the gas-outlet groove 3216, so as to detect the air pollution introduced into the gas-outlet groove 3216. Preferably but not exclusively, in an embodiment, the gas sensor 327 includes a volatile-organic-compound sensor for detecting the gas information of carbon dioxide ($CO_2$) or volatile organic compounds (TVOC). Preferably but not exclusively, in an embodiment, the gas sensor 327 includes a formaldehyde sensor for detecting the gas information of formaldehyde (HCHO). Preferably but not exclusively, in an embodiment, the gas sensor 327 includes a bacteria sensor for detecting the gas information of bacteria or fungi. Preferably but not exclusively, in an embodiment, the gas sensor 327 includes a virus sensor for detecting the gas information of virus.

In the embodiment, the piezoelectric actuator 322 is accommodated in the square-shaped gas-guiding-component loading region 3215 of the base 321. In addition, the gas-guiding-component loading region 3215 of the base 321 is in fluid communication with the gas-inlet groove 3214. When the piezoelectric actuator 322 is enabled, the gas in the gas-inlet 3214 is inhaled into the piezoelectric actuator 322, flows through the ventilation hole 3215*a* of the gas-guiding-component loading region 3215 into the gas-outlet groove 3216. Moreover, the driving circuit board 323 covers the second surface 3212 of the base 321, and the laser component 324 is positioned and disposed on the driving circuit board 323, and is electrically connected to the driving circuit board 323. The particulate sensor 325 is also positioned and disposed on the driving circuit board 323, and is electrically connected to the driving circuit board 323. In that, when the outer cover 326 covers the base 321, the inlet opening 3261*a* is spatially corresponding to the gas-inlet 3214*a* of the base 321, and the outlet opening 3261*b* is spatially corresponding to the gas-outlet 3216*a* of the base 321.

In the embodiment, the piezoelectric actuator 322 includes a gas-injection plate 3221, a chamber frame 3222, an actuator element 3223, an insulation frame 3224 and a conductive frame 3225. In the embodiment, the gas-injection plate 3221 is made by a flexible material and includes a suspension plate 3221*a* and a hollow aperture 3221*b*. The suspension plate 3221*a* is a sheet structure and is permitted to undergo a bending deformation. Preferably but not exclusively, the shape and the size of the suspension plate 3221*a* are accommodated in the inner edge of the gas-guiding-component loading region 3215, but not limited thereto. The hollow aperture 3221*b* passes through a center of the suspension plate 3221*a*, so as to allow the gas to flow therethrough. Preferably but not exclusively, in the embodiment, the shape of the suspension plate 3221*a* is selected from the group consisting of a square, a circle, an ellipse, a triangle and a polygon, but not limited thereto.

In the embodiment, the chamber frame 3222 is carried and stacked on the gas-injection plate 3221. In addition, the shape of the chamber frame 3222 is corresponding to the gas-injection plate 3221. The actuator element 3223 is carried and stacked on the chamber frame 3222. A resonance chamber 3226 is collaboratively defined by the actuator element 3223, the chamber frame 3222 and the suspension plate 3221*a* and is formed between the actuator element 3223, the chamber frame 3222 and the suspension plate 3221*a*. The insulation frame 3224 is carried and stacked on the actuator element 3223 and the appearance of the insulation frame 3224 is similar to that of the chamber frame 3222. The conductive frame 3225 is carried and stacked on the insulation frame 3224, and the appearance of the conductive frame 3225 is similar to that of the insulation frame 3224. In addition, the conductive frame 3225 includes a conducting pin 3225*a* and a conducting electrode 3225*b*. The conducting pin 3225*a* is extended outwardly from an outer edge of the conductive frame 3225, and the conducting electrode 3225*b* is extended inwardly from an inner edge of the conductive frame 3225. Moreover, the actuator element 3223 further includes a piezoelectric carrying plate 3223*a*, an adjusting resonance plate 3223*b* and a piezoelectric plate 3223*c*. The piezoelectric carrying plate 3223*a* is carried and stacked on the chamber frame 3222. The adjusting resonance plate 3223*b* is carried and stacked on the piezoelectric carrying plate 3223*a*. The piezoelectric plate 3223*c* is carried and stacked on the adjusting resonance plate 3223*b*. The adjusting resonance plate 3223*b* and the piezoelectric plate 3223*c* are accommodated in the insulation frame 3224. The conducting electrode 3225*b* of the conductive frame 3225 is electrically connected to the piezoelectric plate 3223*c*. In the embodiment, the piezoelectric carrying plate 3223*a* and the adjusting resonance plate 3223*b* are made by a conductive material. The piezoelectric carrying plate 3223*a* includes a piezoelectric pin 3223*d*. The piezoelectric pin 3223*d* and the conducting pin 3225*a* are electrically connected to a driving circuit (not shown) of the driving circuit board 323, so as to receive a driving signal, such as a driving frequency and a driving voltage. Through this structure, a circuit is formed by the piezoelectric pin 3223*d*, the piezoelectric carrying plate 3223*a*, the adjusting resonance plate 3223*b*, the piezoelectric plate 3223*c*, the conducting electrode 3225*b*, the conductive frame 3225 and the conducting pin 3225*a* for transmitting the driving signal. Moreover, the insulation frame 3224 is insulated between the conductive frame 3225 and the actuator element 3223, so as to avoid the occurrence of a short circuit. Thereby, the driving signal is transmitted to the piezoelectric plate 3223*c*. After receiving the driving signal such as the driving frequency and the driving voltage, the piezoelectric plate 3223*c* deforms due to the piezoelectric effect, and the piezoelectric carrying plate 3223*a* and the adjusting resonance plate 3223*b* are further driven to generate the bending deformation in the reciprocating manner.

Furthermore, in the embodiment, the adjusting resonance plate 3223*b* is located between the piezoelectric plate 3223*c* and the piezoelectric carrying plate 3223*a* and served as a cushion between the piezoelectric plate 3223*c* and the piezoelectric carrying plate 3223*a*. Thereby, the vibration frequency of the piezoelectric carrying plate 3223*a* is adjustable. Basically, the thickness of the adjusting resonance plate 3223*b* is greater than the thickness of the piezoelectric carrying plate 3223*a*, and the vibration frequency of the actuator element 3223 can be adjusted by adjusting the thickness of the adjusting resonance plate 3223*b*.

Please refer to FIG. 7A, FIG. 7B, FIG. 8A, FIG. 8B and FIG. 9A. In the embodiment, the gas-injection plate 3221, the chamber frame 3222, the actuator element 3223, the insulation frame 3224 and the conductive frame 3225 are stacked and positioned in the gas-guiding-component loading region 3215 sequentially, so that the piezoelectric actuator 322 is supported and positioned in the gas-guiding-component loading region 3215. A plurality of clearances 3221*c* are defined between the suspension plate 3221*a* of the gas-injection plate 3221 and an inner edge of the gas-guiding-component loading region 3215 for gas flowing therethrough. In the embodiment, a flowing chamber 3227 is formed between the gas-injection plate 3221 and the bottom surface of the gas-guiding-component loading region 3215. The flowing chamber 3227 is in communication with the resonance chamber 3226 between the actuator element 3223, the chamber frame 3222 and the suspension plate 3221*a* through the hollow aperture 3221*b* of the gas-injection plate 3221. By controlling the vibration frequency of the gas in the resonance chamber 3226 to be close to the vibration frequency of the suspension plate 3221*a*, the Helmholtz resonance effect is generated between the resonance chamber 3226 and the suspension plate 3221*a*, so as to improve the efficiency of gas transportation. When the piezoelectric plate 3223*c* is moved away from the bottom surface of the gas-guiding-component loading region 3215, the suspension plate 3221*a* of the gas-injection plate 3221 is driven to move away from the bottom surface of the gas-guiding-component loading region 3215 by the piezoelectric plate 3223*c*. In that, the volume of the flowing chamber 3227 is expanded rapidly, the internal pressure of the flowing chamber 3227 is decreased to form a negative pressure, and the gas outside the piezoelectric actuator 322 is inhaled through the clearances 3221*c* and enters the resonance chamber 3226 through the hollow aperture 3221*b*. Consequently, the pressure in the resonance chamber 3226 is increased to generate a pressure gradient. When the suspension plate 3221*a* of the gas-injection plate 3221 is driven by the piezoelectric plate 3223*c* to move toward the bottom surface of the gas-guiding-component loading region 3215, the gas in the resonance chamber 3226 is discharged out rapidly through the hollow aperture 3221*b*, and the gas in the flowing chamber 3227 is compressed, thereby the converged gas is quickly and massively ejected out of the flowing chamber 3227 under the condition close to an ideal gas state of the Benulli's law, and transported to the ventilation hole 3215*a* of the gas-guiding-component loading region 3215.

Figure 9A:
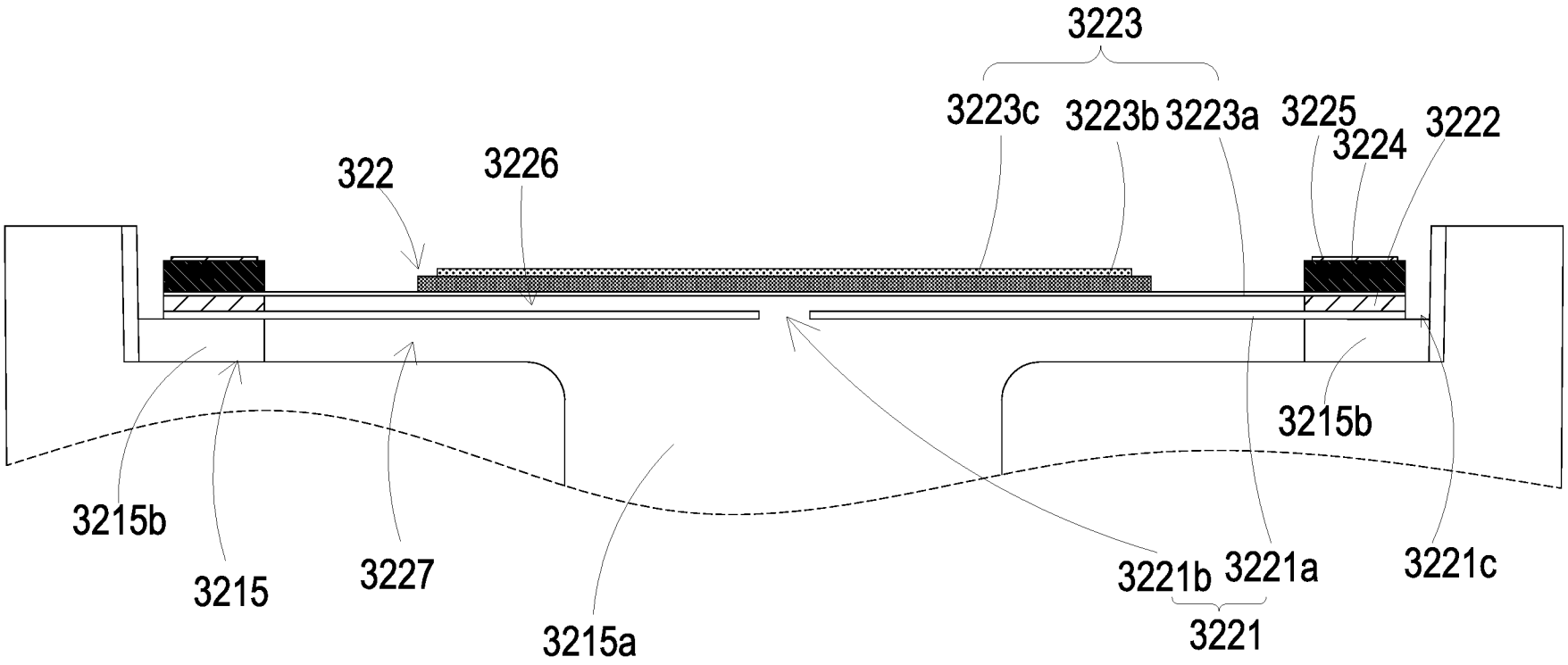
FIG. 9A is a schematic cross-sectional view (1) illustrating an action of the piezoelectric actuator according to the embodiment of the present disclosure.
Figure 9B:
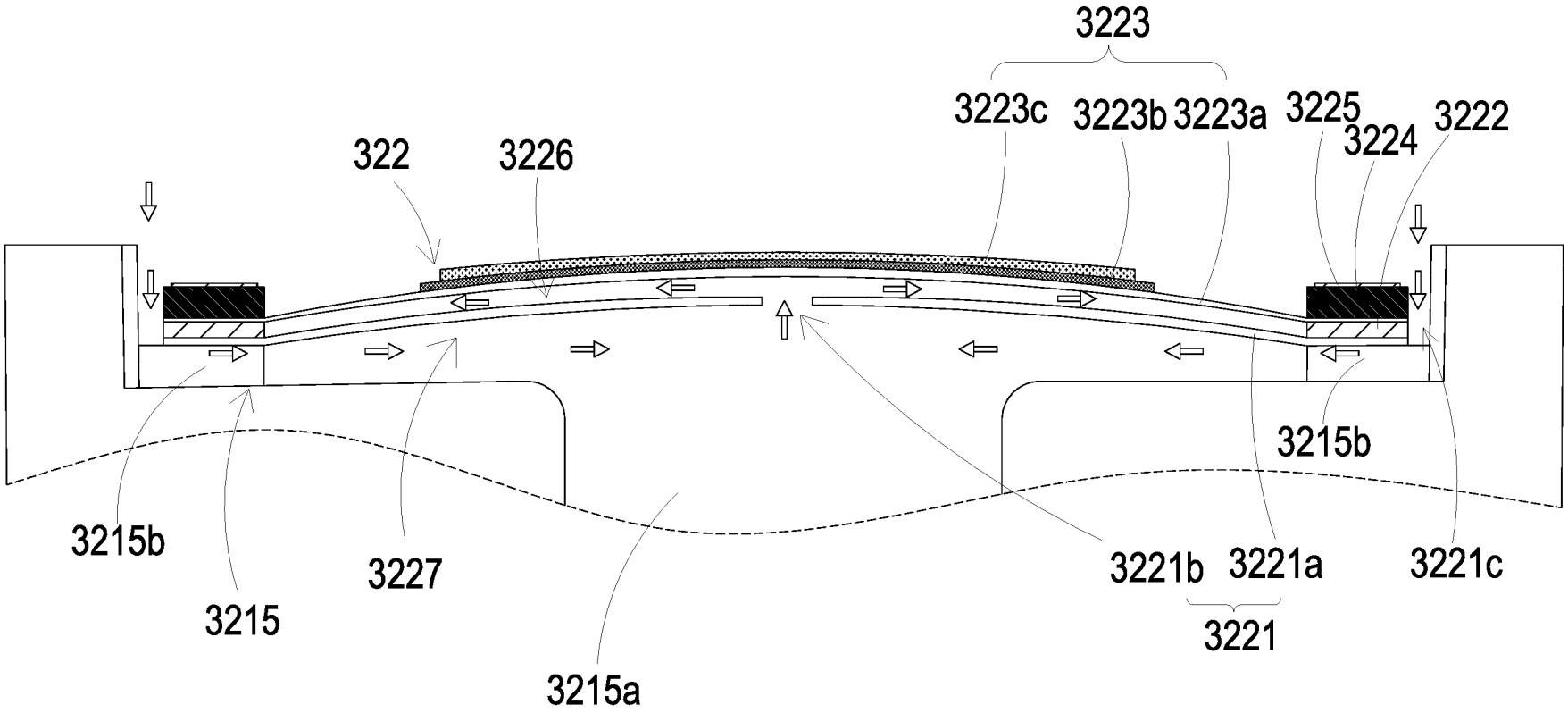
FIG. 9B is a schematic cross-sectional view (2) illustrating of the piezoelectric actuator according to the embodiment of the present disclosure.
Figure 9C:
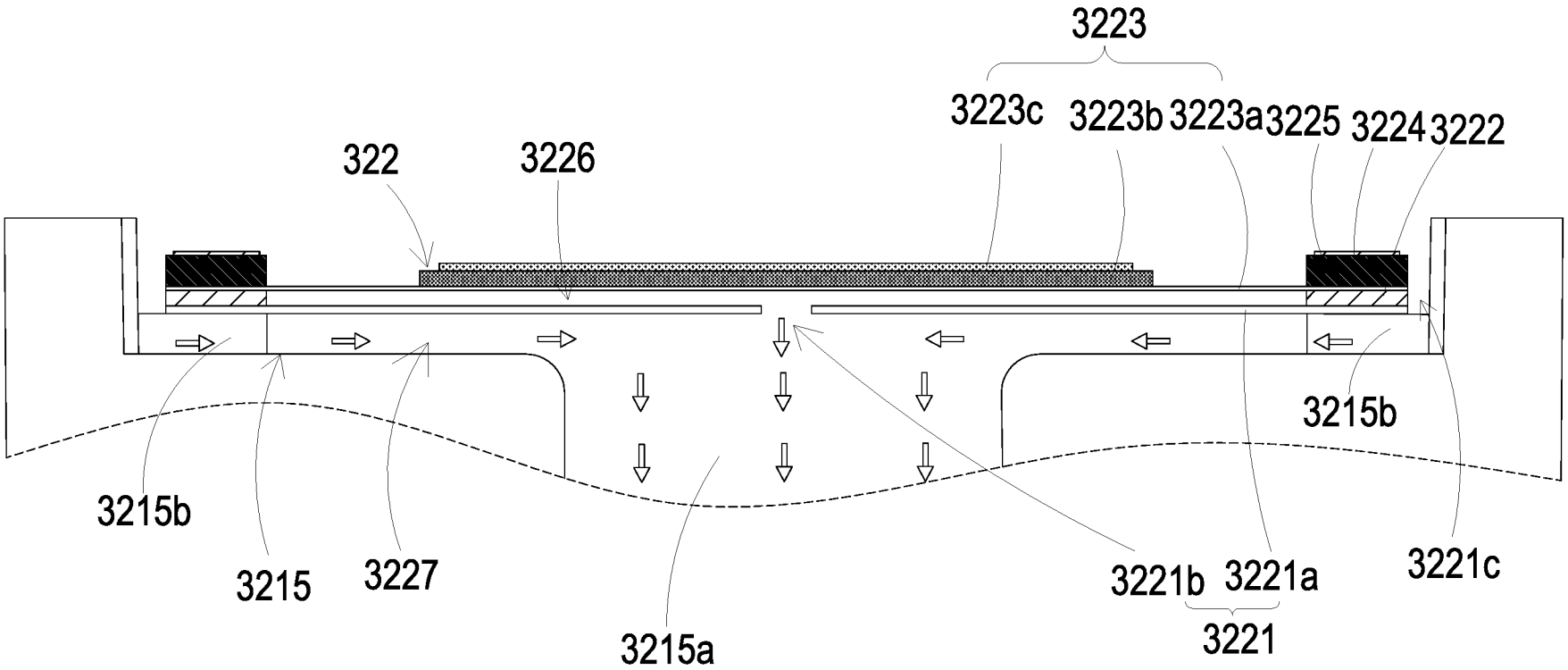
FIG. 9C is a schematic cross-sectional view (3) illustrating an action of the piezoelectric actuator according to the embodiment of the present disclosure.
Figure 10A:
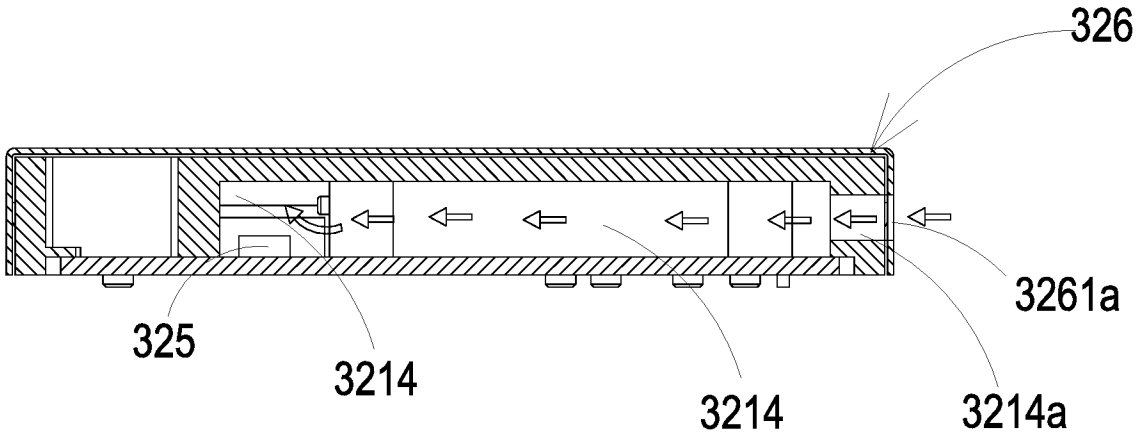
FIG. 10A is a schematic cross-sectional view (1) illustrating the gas detection main part according to the embodiment of the present disclosure.
Figure 10B:
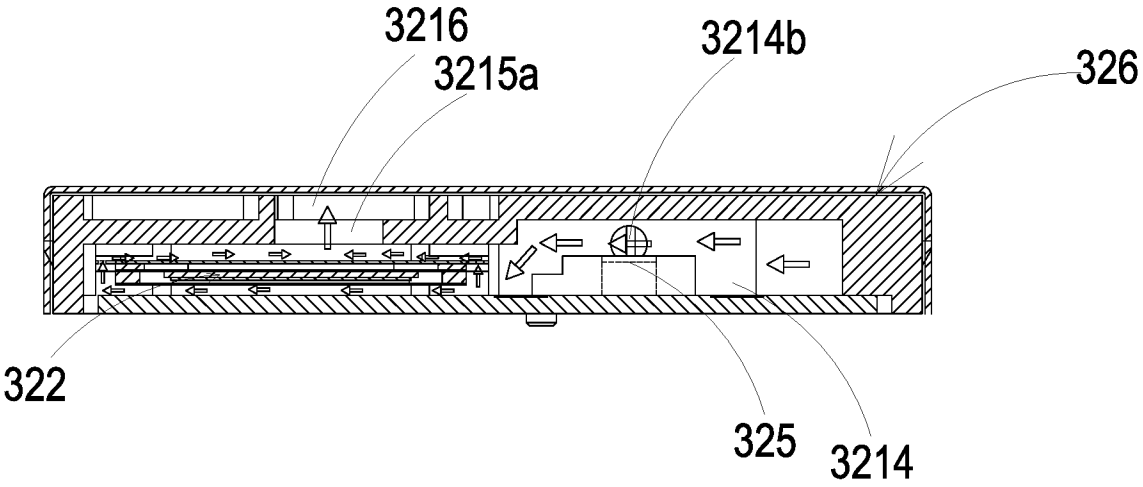
FIG. 10B is a schematic cross-sectional view (2) illustrating the gas detection main part according to the embodiment of the present disclosure.
Figure 10C:
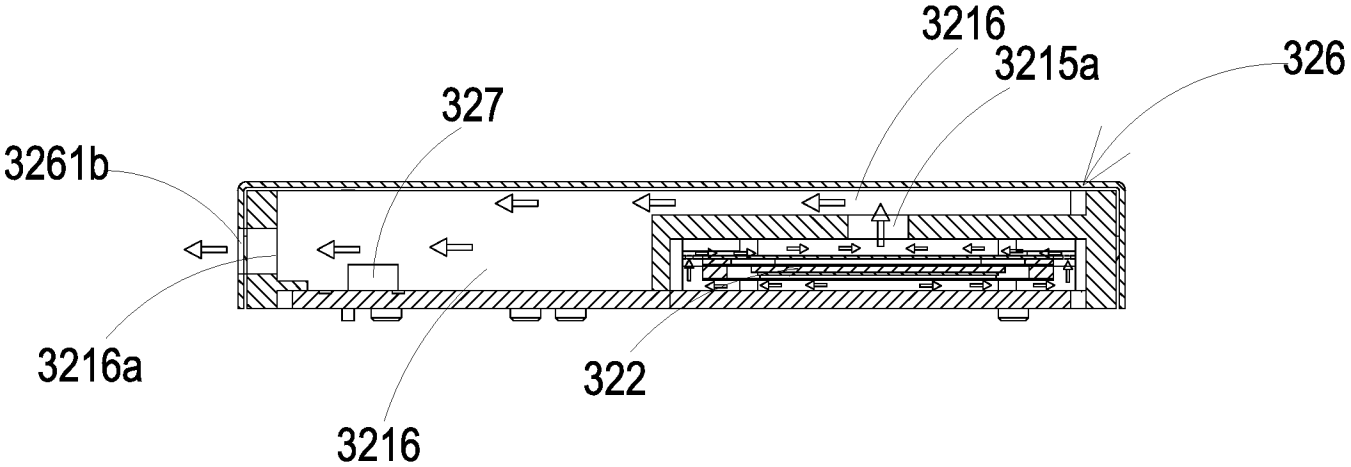
FIG. 10C is a schematic cross-sectional view (3) illustrating the gas detection main part according to the embodiment of the present disclosure.
Figure 11:
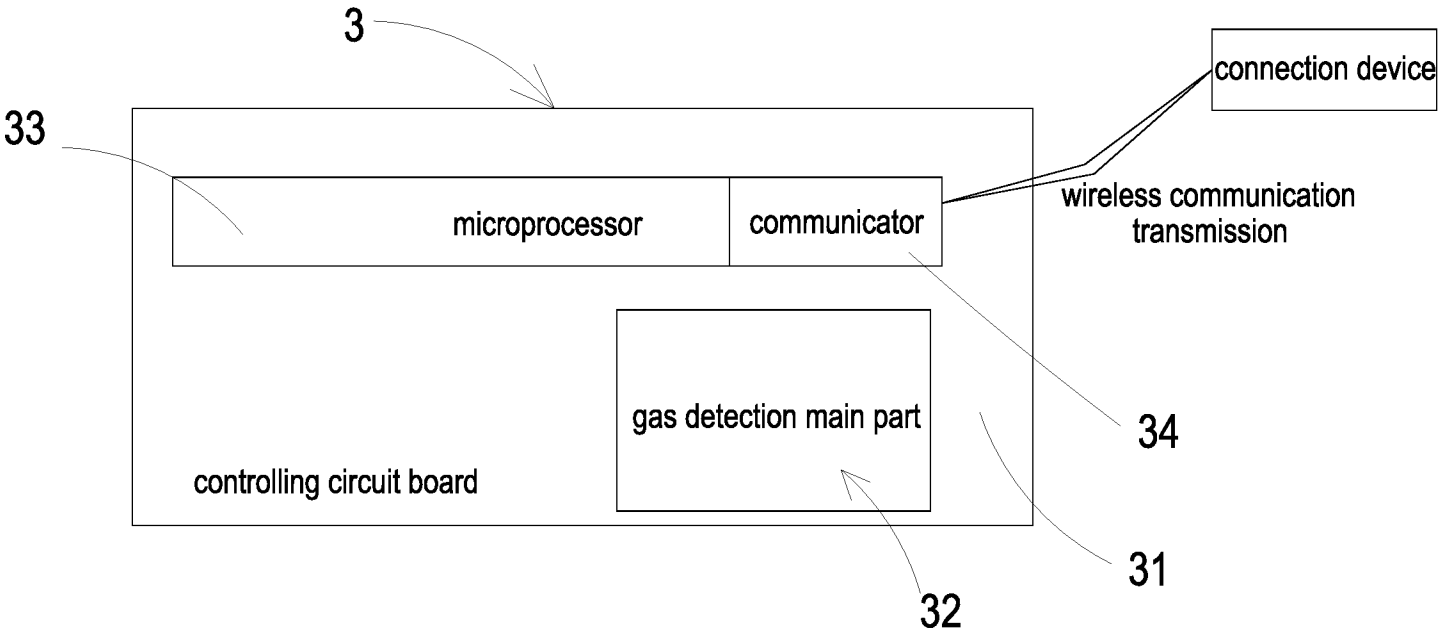
FIG. 11 is a block diagram showing the signal transmission of the gas detection device according to the embodiment of the present disclosure.

By repeating the above operation steps shown in FIG. 9B and FIG. 9C, the piezoelectric plate 3223*c* is driven to generate the bending deformation in a reciprocating manner. According to the principle of inertia, since the gas pressure inside the resonance chamber 3226 is lower than the equilibrium gas pressure after the converged gas is ejected out, the gas is introduced into the resonance chamber 3226 again. Moreover, the vibration frequency of the gas in the resonance chamber 3226 is controlled to be close to the vibration frequency of the piezoelectric plate 3223*c*, so as to generate the Helmholtz resonance effect to achieve the gas transportation at high speed and in large quantities. The gas is inhaled through the inlet opening 3261*a* of the outer cover 326, flows into the gas-inlet groove 3214 of the base 321 through the gas-inlet 3214*a*, and is transported to the position of the particulate sensor 325. The piezoelectric actuator 322 is enabled continuously to inhale the gas into the inlet path, and facilitate the gas outside the gas detection device to be introduced rapidly, flow stably, and transported above the particulate sensor 325. At this time, a projecting light beam emitted from the laser component 324 passes through the transparent window 3214*b* to irritate the suspended particles contained in the gas flowing above the particulate sensor 325 in the gas-inlet groove 3214. When the suspended particles contained in the gas are irradiated and generate scattered light spots, the scattered light spots are received and calculated by the particulate sensor 325 for obtaining related information about the sizes and the concentration of the suspended particles contained in the gas. Moreover, the gas above the particulate sensor 325 is continuously driven and transported by the piezoelectric actuator 322, flows into the ventilation hole 3215*a* of the gas-guiding-component loading region 3215, and is transported to the gas-outlet groove 3216. At last, after the gas flows into the gas outlet groove 3216, the gas is continuously transported into the gas-outlet groove 3216 by the piezoelectric actuator 322, and thus the gas in the gas-outlet groove 3216 is pushed to discharge through the gas-outlet 3216*a* and the outlet opening 3261*b*.

In the present disclosure, the gas detection device A can not only detect the suspended particles in the gas, but also further detect the characteristics of the imported gas, such as formaldehyde, ammonia, carbon monoxide, carbon dioxide, oxygen and ozone. Therefore, the gas detection device A of the present disclosure further includes a gas sensor 327. Preferably but not exclusively, the gas sensor 327 is positioned and electrically connected to the driving circuit board 323, and is accommodated in the gas outlet groove 3216. Whereby, the concentration or the characteristics of volatile organic compounds contained in the gas drained out through the outlet path.

In summary, the present disclosure provides a conception of locating and completely cleaning indoor air pollution. Air pollution may occur at any time and move around an indoor space at any time. A plurality of physical or chemical gas detection devices are widely disposed to intelligently determine a characteristic, a concentration and a location of the air pollution. Moreover, the wired and wireless network is used, various mathematical operations and artificial intelligence operations are implemented through a cloud device to determine the location of the air pollution, a physical or chemical filtration device closest to the location of the air pollution is intelligently selected and enabled to generate an airflow, and the air pollution is quickly drained to at least one filtration device for filtering and completely cleaning the air pollution. As a result, air pollution-locating, air pollution-draining and air pollution-completely-cleaning are formed for handling the air pollution in the indoor space, and a clean and safe breathing air state is achieved. The present disclosure includes the industrial applicability and the inventive steps.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A method for locating and completely cleaning indoor air pollution, comprising:

providing a plurality of physical first devices or a plurality of chemical first devices disposed in an indoor space to determine a characteristic, a concentration and a location of air pollution, wherein the air pollution occurs at any time and moves in the indoor space at any time; and selectively enabling a fan, one of a plurality of physical second devices or one of a plurality of chemical second devices, that is closest to the location of the air pollution determined through the plurality physical first devices or the plurality of chemical first devices to generate an airflow, such that particles of the air pollution and molecules of the air pollution are drained to the enabled physical second device or the enabled chemical second device, so as to filter and completely clean the particles of the air pollution and the molecules of the air pollution, wherein the fan, each one the plurality of physical second devices and each one of the plurality chemical second devices are located separately in different enclosures;

wherein mathematical operations and artificial intelligence operations are implemented to improve efficiency of locating the air pollution, draining the air pollution and completely cleaning the air pollution, wherein a wired and wireless network is utilized to optimize efficacy of the enabled physical second device or the enabled chemical second device for locating the air pollution, draining the air pollution and completely cleaning the air pollution, wherein the mathematical operations are utilized through the wired and wireless network to maximize effects of the enabled physical second device and the enabled chemical second device for completely cleaning the air pollution, wherein the physical first device or the chemical first device is a gas detection device, wherein the characteristic, the concentration and the location of the air pollution are detected to determine the air pollution data through the plurality of gas detection devices, wherein the air pollution data detected in the indoor space are received and compared by the plurality of gas detection devices, then the air pollution data are intelligently calculated to determine the characteristic and the concentration of the air pollution, and the highest one of the air pollution data is intelligently calculated to determine the location of the air pollution in the indoor space, wherein a controlling instruction is intelligently and selectively issued to enable the fan, the physical second device or the chemical second device that is closest to the location of the air pollution first, and then the controlling instruction is intelligently and selectively issued to enable all of other fan(s), rest of the plurality of physical second device(s) and rest of the plurality of chemical second device(s), so as to guide the airflow toward a direction, whereby the flow of the air pollution is accelerated to drain by the airflow toward the physical second device or the chemical second device that is closest to the location of the air pollution for filtering and completely cleaning so as to filter and completely clean the air pollution in the indoor space to form a clean and safe breathing air state.

2. The method for locating and completely cleaning indoor air pollution according to claim 1, wherein the air pollution is at least one selected from the group consisting of suspended particulate matter, carbon monoxide, carbon dioxide, ozone, sulfur dioxide, nitrogen dioxide, lead, total volatile organic compounds (TVOC), formaldehyde, bacteria, fungi, virus and a combination thereof.

3. The method for locating and completely cleaning indoor air pollution according to claim 1, wherein the gas detection device comprises a controlling circuit board, a gas detection main part, a microprocessor and a communicator, and the gas detection main part, the microprocessor and the communicator are integrally packaged on the controlling circuit board and electrically connected to the controlling circuit board, wherein the microprocessor controls the detection of the gas detection main part, the gas detection main part detects the air pollution and outputs a detection signal, and the microprocessor receives and processes the detection signal to generate air pollution data, and provides the air pollution data to the communicator for a wireless communication transmission externally.

4. The method for locating and completely cleaning indoor air pollution according to claim 3, wherein the wireless communication transmission is one selected from the group consisting of a Wi-Fi communication transmission, a Bluetooth communication transmission, a radio frequency identification communication transmission and a near field communication (NFC) transmission.

5. The method for locating and completely cleaning indoor air pollution according to claim 3, wherein the gas detection main part comprises:

a base comprising:

a first surface;

a second surface opposite to the first surface;

a laser loading region hollowed out from the first surface to the second surface;

a gas-inlet groove concavely formed from the second surface and disposed adjacent to the laser loading region, wherein the gas-inlet groove comprises a gas-inlet and two lateral walls, the gas-inlet is in communication with an environment outside the base, and a transparent window is opened on the two lateral walls and is in communication with the laser loading region;

a gas-guiding-component loading region concavely formed from the second surface and in communication with the gas-inlet groove, wherein a ventilation hole penetrates a bottom surface of the gas-guiding-component loading region; and a gas-outlet groove concavely formed from the first surface, spatially corresponding to the bottom surface of the gas-guiding-component loading region, and hollowed out from the first surface to the second surface in a region where the first surface is not aligned with the gas-guiding-component loading region, wherein the gas-outlet groove is in communication with the ventilation hole, and a gas-outlet is disposed in the gas-outlet groove;

a piezoelectric actuator accommodated in the gas-guiding-component loading region;

a driving circuit board covering and attached to the second surface of the base;

a laser component positioned and disposed on the driving circuit board, electrically connected to the driving circuit board, and accommodated in the laser loading region, wherein a light beam path emitted from the laser component passes through the transparent window and extends in a direction perpendicular to the gas-inlet groove, thereby forming an orthogonal direction with the gas-inlet groove;

a particulate sensor positioned and disposed on the driving circuit board, electrically connected to the driving circuit board, and disposed at an orthogonal position where the gas-inlet groove intersects the light beam path of the laser component in the orthogonal direction, so that suspended particles of the air pollution source passing through the gas-inlet groove and irradiated by a projecting light beam emitted from the laser component are detected;

a gas sensor positioned and disposed on the driving circuit board, electrically connected to the driving circuit board, and accommodated in the gas-outlet groove, so as to detect the air pollution source introduced into the gas-outlet groove; and an outer cover covering the base and comprising a side plate, wherein the side plate has an inlet opening and an outlet opening, the inlet opening is spatially corresponding to the gas-inlet of the base, and the outlet opening is spatially corresponding to the gas-outlet of the base;

wherein the outer cover covers the base, and the driving circuit board covers the second surface, thereby an inlet path is defined by the gas-inlet groove, and an outlet path is defined by the gas-outlet groove, so that the air pollution source is inhaled from the environment outside the base by the piezoelectric actuator, transported into the inlet path defined by the gas-inlet groove through the inlet opening, and passes through the particulate sensor to detect the particle concentration of the suspended particles contained in the air pollution source, and the air pollution source transported through the piezoelectric actuator is transported out of the outlet path defined by the gas-outlet groove through the ventilation hole, passes through the gas sensor for detecting, and then discharged through the outlet opening.

6. The method for locating and completely cleaning indoor air pollution according to claim 5, wherein the particulate sensor is used for detecting a suspended particulate information.

7. The method for locating and completely cleaning indoor air pollution according to claim 5, wherein the gas sensor comprises a volatile-organic-compound sensor for detecting a gas information of carbon dioxide or total volatile organic compounds.

8. The method for locating and completely cleaning indoor air pollution according to claim 5, wherein the gas sensor comprises a formaldehyde sensor for detecting a gas information of formaldehyde.

9. The method for locating and completely cleaning indoor air pollution according to claim 5, wherein the gas sensor comprises a bacteria sensor for detecting a gas information of bacteria or fungi.

10. The method for locating and completely cleaning indoor air pollution according to claim 5, wherein the gas sensor comprises a virus sensor for detecting a gas information of virus.

11. The method for locating and completely cleaning indoor air pollution according to claim 1, wherein the plurality of physical second devices or the plurality of chemical second devices are filtration device.

12. The method for locating and completely cleaning indoor air pollution according to claim 11, wherein the filtration device is a blocking and absorbing filter screen to form a physical removal device.

13. The method for locating and completely cleaning indoor air pollution according to claim 12, wherein the filter screen is a high efficiency particulate air (HEPA) filter screen.

14. The method for locating and completely cleaning indoor air pollution according to claim 11, wherein the filtration device is a filter element coated with a decomposition layer to form a chemical removal device.

15. The method for locating and completely cleaning indoor air pollution according to claim 14, wherein the decomposition layer is an activated carbon.

16. The method for locating and completely cleaning indoor air pollution according to claim 14, wherein the decomposition layer is a cleansing factor containing chlorine dioxide layer.

17. The method for locating and completely cleaning indoor air pollution according to claim 14, wherein the decomposition layer is an herbal protective layer extracted from ginkgo and Japanese *Rhus chinensis* to form an herbal protective anti-allergic filter.

18. The method for locating and completely cleaning indoor air pollution according to claim 14, wherein the decomposition layer is a silver ion.

19. The method for locating and completely cleaning indoor air pollution according to claim 14, wherein the decomposition layer is a zeolite.

20. The method for locating and completely cleaning indoor air pollution according to claim 14, wherein the filtration device is a filter element combined with a light irradiation element to form a chemical removal device.

21. The method for locating and completely cleaning indoor air pollution according to claim 20, wherein the light irradiation element is a photo-catalyst unit comprising a photo catalyst and an ultraviolet lamp.

22. The method for locating and completely cleaning indoor air pollution according to claim 20, wherein the light irradiation element is a photo-plasma unit comprising a nanometer irradiation tube.

23. The method for locating and completely cleaning indoor air pollution according to claim 11, wherein the filtration device is a filter element combined with a decomposition unit to form a chemical removal device.

24. The method for locating and completely cleaning indoor air pollution according to claim 23, wherein the decomposition unit is a negative ion unit.

25. The method for locating and completely cleaning indoor air pollution according to claim 23, wherein the decomposition unit is a plasma ion unit.

26. The method for locating and completely cleaning indoor air pollution according to claim 11, wherein the gas detection device is connected to the a cloud device through the wired and wireless network to analyze the air pollution data utilizing the mathematical operations through the wired and wireless network to maximize effects of the physical second device and the chemical second device that is closest to the location of the air pollution for completely cleaning the air pollution, wherein the artificial intelligence operations and big data comparison are implemented through the cloud device to find out the location of the air pollution in the indoor space, and the controlling instruction is intelligently and selectively issued through the wired and wireless network and transmitted to drive the fan, the physical filtration device or the chemical filtration device, so as to filter and completely clean the air pollution in the indoor space to form the clean and safe breathing air state.

* * * * *